United States Patent [19]

Schmidt

[11] Patent Number: 4,511,145

[45] Date of Patent: Apr. 16, 1985

[54] REINFORCED HOLLOW METAL GOLF CLUB HEAD

[76] Inventor: Glenn H. Schmidt, 1857 Los Encinos, Glendale, Calif. 91208

[21] Appl. No.: 514,975

[22] Filed: Jul. 18, 1983

[51] Int. Cl.[3] ..... A63B 53/04

[52] U.S. Cl. ..... 273/167 H; 273/169

[58] Field of Search ..... 273/167 H, 169, 167 J, 273/167 F, 170, 171, 172, 175

[56] References Cited

FOREIGN PATENT DOCUMENTS 1476889 6/1977 United Kingdom ..... 273/167 H 2100993 1/1983 United Kingdom ..... 273/169

*Primary Examiner*—George J. Marlo

*Attorney, Agent, or Firm*—William W. Haefliger

[57] ABSTRACT

A hollow metal shell golf club head, has a ball striking front wall, a top wall, a bottom wall and longitudinally spaced toe and heel walls. The head is characterized by:

(a) said front wall having front side, and a rear side exposed to the hollow interior of the head, (b) and a metallic ridge integral with said front wall and extending longitudinally and downwardly from a central region of the front wall and adjacent said rear side thereof to transfer ball impact loading to at least one of said toe and heel walls.

7 Claims, 7 Drawing Figures

REINFORCED HOLLOW METAL GOLF CLUB HEAD

BACKGROUND OF THE INVENTION

This invention relates generally to strengthening of metallic, hollow golf club heads (woods). More particularly, it concerns the distribution of ball impact loading from the head front wall in such manner as to resist deflection of that front wall and to absorb such distributed loading on walls spaced from a metallic sole plate welded to the head.

Thin-walled metal golf club heads present the problem of excessive front wall deflection during ball impact, and possible permanent deformation of that front wall. Also during fabrication of golf club metal heads (woods) of hollow configuration, an opening is formed in the bottom wall of the head. That opening is typically covered or filled by weld attachment of a sole plate to the rim bounding the opening. The opening results from the lost wax process of fabrication, wherein metal core parts are removed from the wax shell via the precursor opening in that shell. It is desirable that front wall reinforcement be provided and spaced from that sole plate.

SUMMARY OF THE INVENTION

It is a major object of the invention to provide structure overcoming the above problems and disadvantages. Basically, the improved head of the invention is characterized by a ball striking front wall, a bottom wall, and longitudinally spaced toe and heel walls, as well as:

(a) the front wall having a front side, and a rear side exposed to the hollow interior of the head, (b) and a metallic ridge integral with the front wall and extending longitudinally and downwardly from a central region of the front wall and adjacent the rear side thereof to transfer ball impact loading to at least one of the toe and heel walls.

Typically, the ridge extends arcuately longitudinally and downwardly, merging endwise with the head proximate the juncture of the bottom wall with at least one of the toe and heel walls. Such merge location (or locations) while being spaced from the sole plate weld to the head, still enables the ridge to provide very good front wall support by virtue of its being integral with that wall along its length (to resist bending in that mode); and the ridge may have highly advantageous arched configuration adjacent the front wall to take advantage of arched support strength modes. Also, ball impact loading is distributed by the arched ridge.

These and other objects and advantages of the invention, as well as the details of an illustrative embodiment, will be more fully understood from the following description and drawings, in which:

DRAWING DESCRIPTION

DETAILED DESCRIPTION

Figure 1:
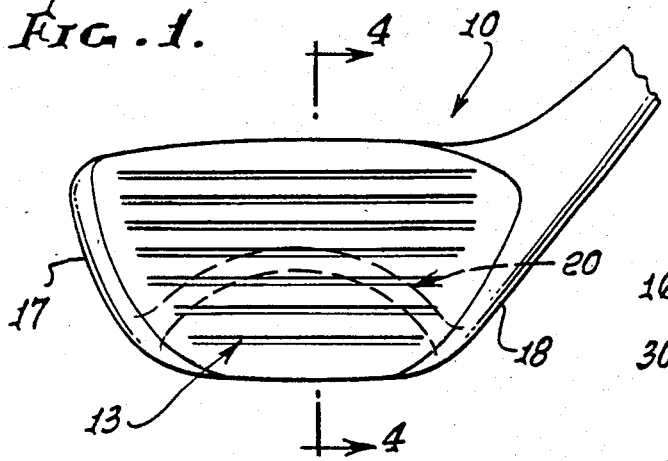
FIG. 1 is a front view of a golf club head incorporating the invention.
Figure 4:
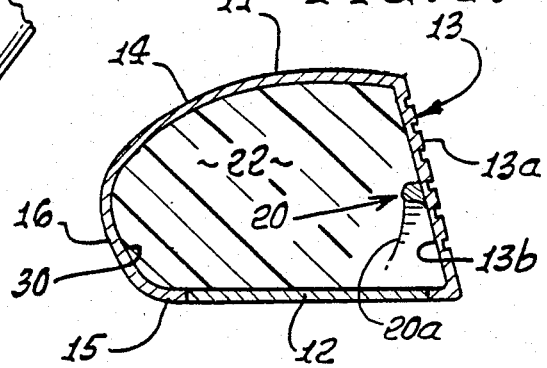
FIG. 4 is a section on lines 4—4 of FIG. 1.
Figure 2:
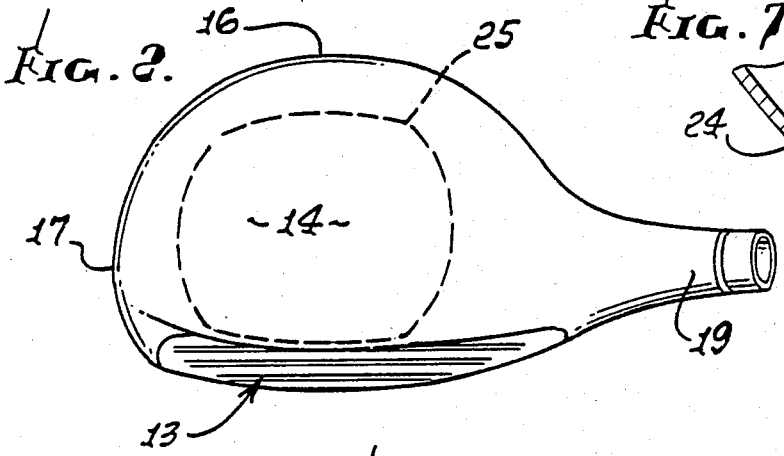
FIG. 2 is a top plan view of the FIG. 1 head.

In the drawings, the golf club head 10 comprises a thin metallic shell 11 and a thin metallic sole plate 12. Preferably these elements comprise steel. The shell includes a front wall 13 having a front face 13*a* adapted to strike a golf ball, thin top and bottom walls 14 and 15, and rear wall 16. Also, the head includes a toe portion 17, and a heel portion 18. A hosel appears at 19. The shell defines a hollow interior 30, and prior to attachment of the sole plate to the shell, the interior opens at 31 to the exterior. One reason for that opening in bottom wall 15 is to allow for removal of core structure during the fabrication of the hollow shell, as by the lost wax process. The hollow interior is ultimately filled with foamed plastic material (which may consist of polyurethane) as seen at 22 in FIG. 4.

The invention concerns the provision of ridge or rib structure integral with the front wall 13, and extending longitudinally and downwardly from a central region of the front wall and adjacent the rear side 13*b* of that wall, to transfer ball impact loading to at least one of the toe and heel walls.

Figure 5:
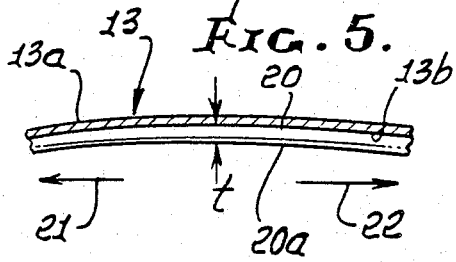
FIG. 5 is a top plan view of ridge reinforcement.

As shown in the drawings, a ridge 20 embodying the invention extends arcuately longitudinally (see longitudinal directional arrows 21 and 22 in FIG. 5) at the rear side of wall 13, and is integral with that wall along the length of the ridge. The ridge thickness "t" in a forward direction may vary, as for example by increasing along the ridge longitudinal length in directions 21 and 22, or may remain constant. However, the rear surface 20*a* of the ridge curves rearwardly, in directions 21 and 22, as for example due to the curvature of the front wall 13 to distribute loading to the toe and heel walls of the head, at zones 23 and 24 in FIG. 3. Advantages include ball impact load distribution to the head wall regions variably spaced from but preferably close to the looping sole plate weld 25 to the bottom wall 15; load distribution to multiple spaced wall regions including front wall regions as well as toe and heel wall along the length of that wall regions; and the provision of "arch" support for the front wall to reduce its rearward deflection. Note in this regard the arched rear surface 20*a* of the ridge, in FIG. 5, and the downwardly arched configuration of the ridge in FIG. 3. Thus, a high-strength, compound arch is provided, to extend across the sweet spot (central region) of the front wall. Each half of the arched ridge, left and right of the crest, may have helical curvature, as seen and represented by numeral 20*a* in FIG. 4, which also illustrates forward arching.

Figure 3:
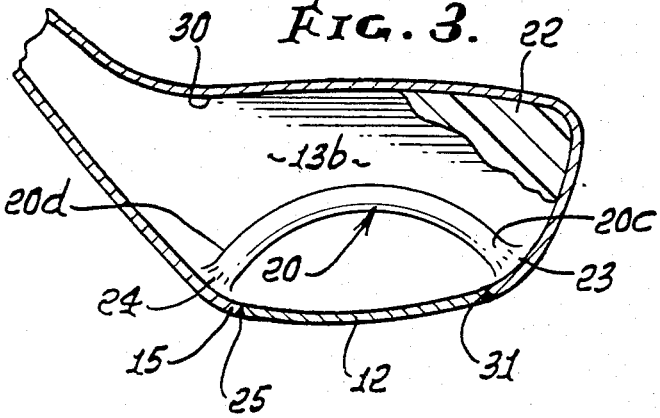
FIG. 3 is an interior elevational view of the FIG. 1 head showing the rear of the front face.

As shown, the ridge or rib may merge endwise with the head proximate the juncture of the bottom wall 15 with the toe and heel walls (see FIG. 3). Such junctures have substantial curvature to provide maximum resistance to deflection upon imposition of loading from the ridge 20. The ridge ends 20*c* and 20*d* may be thickened, as shown, in rearward as well as an upward and downward direction. As seen in FIGS. 1, 3, 4, and 6, the rib has upper and lower sides each of which is arched upwardly throughout the major lengthwise extent of the rib between the rib opposite end portions 20*c* and 20*d*, as is rib surface 20*a* as explained above.

Figure 6:
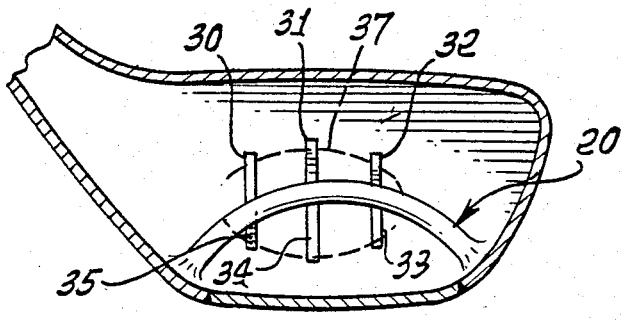
FIG. 6 is a view like FIG. 3, showing a modification.

FIG. 6, like FIG. 3, shows additional vertical support ribs 30–35 associated with ridge 20, above and below its central regions at the rear of the sweet spot (indicated at 37).

Figure 7:
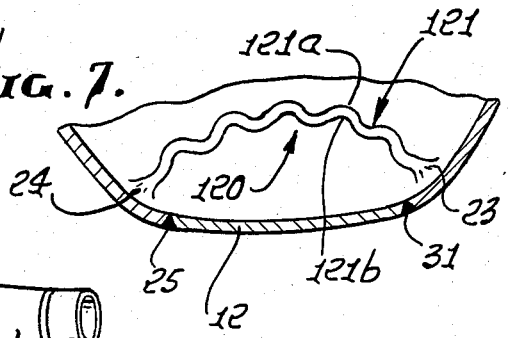
FIG. 7 is a framentary view like FIG. 3.

FIG. 7 is like FIG. 3, but shows a modified ridge 120 that undulates along its length, to provide enhanced strength and cushoning of force transmission along its length. Note the sequence of wave like undulations 121, with convex and concave sides 121*a* and 121*b*.

I claim:

1. In a hollow metallic golf club head having a ball striking front wall, a top wall, a bottom wall, and longitudinally spaced toe and heel walls, the improvement comprising (a) said front wall having a front side, and a rear side exposed to the hollow interior of the head, (b) and a metallic ridge in the form of an arch integral with said front wall and extending longitudinally and downwardly adjacent said front wall from a central region of the front wall and adjacent said rear side thereof to transfer ball impact loading to said toe and heel walls, (c) said ridge having the form of a rib with opposite end portions, and upper, rear and lower surfaces each of which is arched upwardly throughout the major lengthwise extent of the rib between said opposite end portions, said opposite end portions approaching said toe and heel walls increasing substantially in forward and rearward thickness, whereby the rib has compound arching configuration for impact load transfer to said toe and heel walls.

2. The improvement of claim 1 wherein said ridge extends everywhere adjacent said front wall.

3. The improvement of claim 2 wherein said ridge merges endwise with said head proximate the juncture of said bottom wall with each of the toe and heel walls, the top of the ridge located rearward of the sweet spot associated with the front wall.

4. The improvement of claim 1 wherein said bottom wall includes a sole plate welded to the head, and said ridge is everywhere spaced from said sole plate.

5. The improvement of claim 1 wherein said ridge has helical configuration.

6. The improvement of claim 1 including additional ribbing integral with said front wall and associated with said ridge.

7. The improvement of claim 1 wherein said ridge undulates along its length.

* * * * *